United States Patent [19]

De Nora et al.

[11] 3,976,550

[45] Aug. 24, 1976

[54] HORIZONTAL, PLANAR, BIPOLAR DIAPHRAGM CELLS

[75] Inventors: Oronzio De Nora, Milan, Italy; Vittorio De Nora, Nassau, Bahamas

[73] Assignee: Oronzio de Nora Implanti Elettrochimici S.p.A., Milan, Italy

[22] Filed: May 15, 1974

[21] Appl. No.: 470,281

Related U.S. Application Data

[63] Continuation of Ser. No. 227,148, Feb. 17, 1972, abandoned.

[30] Foreign Application Priority Data

Sept. 22, 1971 Italy ..... 28938/71

[52] U.S. Cl. ..... 204/98; 204/128; 204/254; 204/255; 204/256; 204/258; 204/266; 204/286

[51] Int. Cl.[2] ..... C25B 1/14; C25B 1/26; C25B 9/00; C25B 9/02

[58] Field of Search ..... 204/98, 128, 254, 255, 204/256, 258, 266, 286

[56] References Cited

UNITED STATES PATENTS

| | | | |
|---|---|---|---|
| 903,951 | 11/1908 | Billiter | 204/98 |
| 984,905 | 2/1911 | Greenwood | 204/98 |
| 1,907,818 | 5/1933 | Hunter | 204/256 |
| 3,684,670 | 8/1972 | Raetzsch | 204/266 X |
| 3,755,105 | 8/1973 | Messner | 204/128 X |

*Primary Examiner*—John H. Mack
*Assistant Examiner*—A. C. Prescott
*Attorney, Agent, or Firm*—Hammond & Littell

[57] ABSTRACT

Describes a bipolar diaphragm cell consisting of a series of substantially horizontal frames stacked one on top of the other with the interposition of insulating gaskets. These frames house the cathode compartment in the upper part and the anode compartment in the lower part of each frame; these compartments are separated by a horizontal plate supporting the cathode screen and diaphragm on its upper side and the anodic structure from its lower side; the anodic structure consisting of a valve metal base having an electrically conductive electrocatalytic coating thereon and having sufficient voids through the metal of the anode base to readily pass anode gases upwardly through the anodes.

31 Claims, 23 Drawing Figures

BRINE EXCESS

NaOH
CONDENSATE
BRINE
BRINE
NaOH
Cl2
H2
A
A6
A7
A1
G
I1
I2
H1
J
M
M1
B
L1
F3
3
4

4
9a
4a
8b
8
8a
4b
8d
3
4c
5b
10
3a
6
8c
9a
5e
5i
5

HORIZONTAL, PLANAR, BIPOLAR DIAPHRAGM CELLS

This is a continuation, of Ser. No. 227,148, filed Feb. 17, 1972 now abandoned.

This invention relates to horizontal diaphragm electrolysis cells such as used, for example, in the electrolysis of aqueous solutions of alkali metal halides. As a specific embodiment, the invention will be described for use in the electrolysis of sodium chloride to produce chlorine, hydrogen and sodium hydroxide, but it will be understood that the apparatus and process described herein may be used for many other electrolysis processes such as the electrolysis of aqueous solutions of other alkali metal halides, the production of chlorates and the electrolysis of other solutions to produce electrolysis products.

The invention uses dimensionally stable anodes comprising a valve metal base, for example, of titanium or tantalum or alloys thereof, which is resistant to cell conditions and which is provided with an electrically conductive electrocatalytic coating of one or more oxides of platinum group metals with other protective oxides, such as, oxides of titanium, or with a coating of platinum group metals in metallic form which will not passivate over long periods of time.

As will be described later, these dimensionally stable anodes are in screen, mesh, rod or other open forms having approximately from 30 to 60%, preferably 50 to 53%, voids as compared with the overall projecting area of the anode screens, so that chlorine or other gas bubbles formed at the anodes may readily pass through the horizontally mounted anodes anad escape at the top of the anode screens, so that gas blanketing of the anodes and the discharge of gases from the anodes mounted in horizontal position presents no problem and the bubble effect becomes negligible. These dimensionally stable metal anodes may give several years of service without renewal, whereas, graphite anodes as used in the past, require renewal about every six to eight months (with complete dismantling of the cell) because of consumption of graphite and when mounted in horizontal position are subject to gas blanketing, as the number of voids (holes through the anode) in graphite anodes must be very small to avoid too great weakening of the graphite anodes.

One of the objects of this invention is to provide a horizontal diaphragm electrolysis cell using plane electrodes in horizontal position with the anodes having more than 30 to 60% of voids, whereby discharge of the anodic gases is facilitated and gas blanketing of the anodes avoided.

Another object is to provide bipolar diaphragm electrolysis cells with horizontal, planar electrodes, in which open mesh metal anodes are used.

Another object of the invention is to provide a diaphragm electrolysis cell which consists of a series of horizontal frame members, stacked one on top of the other, with substantially planar anodes, cathodes and diaphragms mounted in substantially horizontal position within the horizontal frame members, whereby assembly and disassembly of the cell is facilitated.

Another object of the invention is to provide a stacked bipolar diaphragm electrolysis cell, which will occupy small floor space with reference to its capacity.

Another object of our invention is to provide a stacked horizontal diaphragm cell in which the frame members constituting the stack are alternately of a conductive metal (such as steel or other ferrous metal) and a non-conductive electrically insulating chemically resistant material, such as glass fiber reinforced polyester, polyvinyl chloride or the like.

Another object of our invention is to provide a diaphragm electrolysis cell which consists of a series of substantially horizontal units, stacked one on top of the other with the interposition of electrically insulating gaskets, these units consisting of a horizontal frame surrounding a flat sheet which supports the cathode screen on its upper side and the anodic structure from its lower side.

Various other objects and advantages of these inventions will become apparent as this description proceeds.

The novel horizontal bipolar diaphragm electrolysis cell of this invention is comprised of a cathode compartment at the bottom, a plurality of bipolar units stacked one on top of the other and an anode compartment at the top with electrically insulating gaskets interposed between each of the stacked frames, each of said units consisting of an anode compartment adapted to contain an anolyte liquor in its lower side and a cathode compartment adapted to contain a catholyte liquor on its upper side, a cathode compartment closed on the top by a metallic screen (for example, an iron mesh or iron rods screen etc.) which represents the cathode on which the cathodic diaphragm is placed. An anode compartment adapted to contain horizontal, substantially planar valve metal anodes, having 30 to 60% of voids and having an electrically conductive electrocatalytic coating on each anode and in electrical connection with the cathode of the cell situated above, means to feed anolyte liquor into each of said anode compartments and to remove anolyte gas from said compartments, means to remove catholyte liquor and catholyte gas from the cathode compartments and means to convey electric current through each of said cell units to electrolyze the anolyte liquor fed to said anode compartments.

Referring now to the drawings which illustrate preferred forms of embodiment of the invention:

FIG. 1 is a vertical cross section through a stacked bipolar electrolysis cell substantially on the line 1 — 1 of FIG. 2, illustrating the construction and operation of the cells of this invention;

FIGS. 1*a* and 1*b* are details of another form of bipolar connections between the cathodes and anodes of a bipolar cell;

Figure 5:
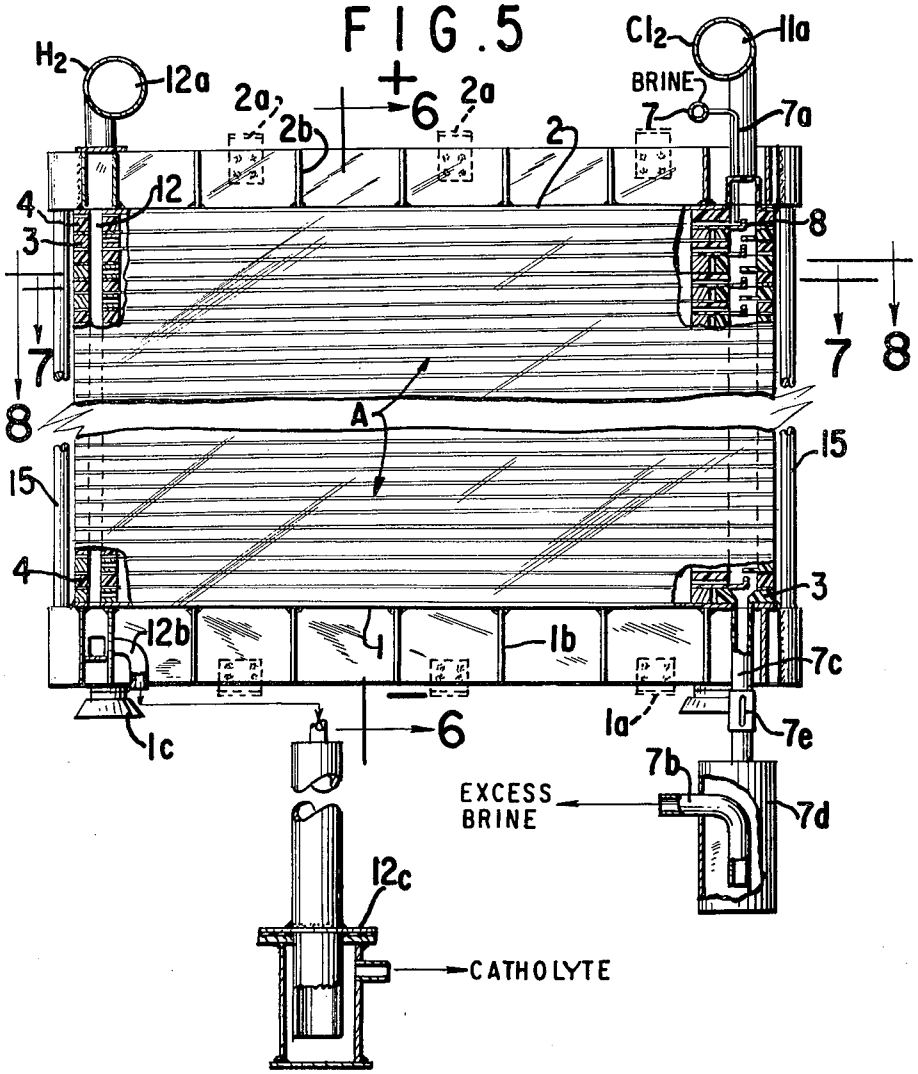
FIG. 5 is a side elevation, partially in section, of another embodiment of a stacked bipolar electrolysis cell constructed according to our invention.
Figure 9:
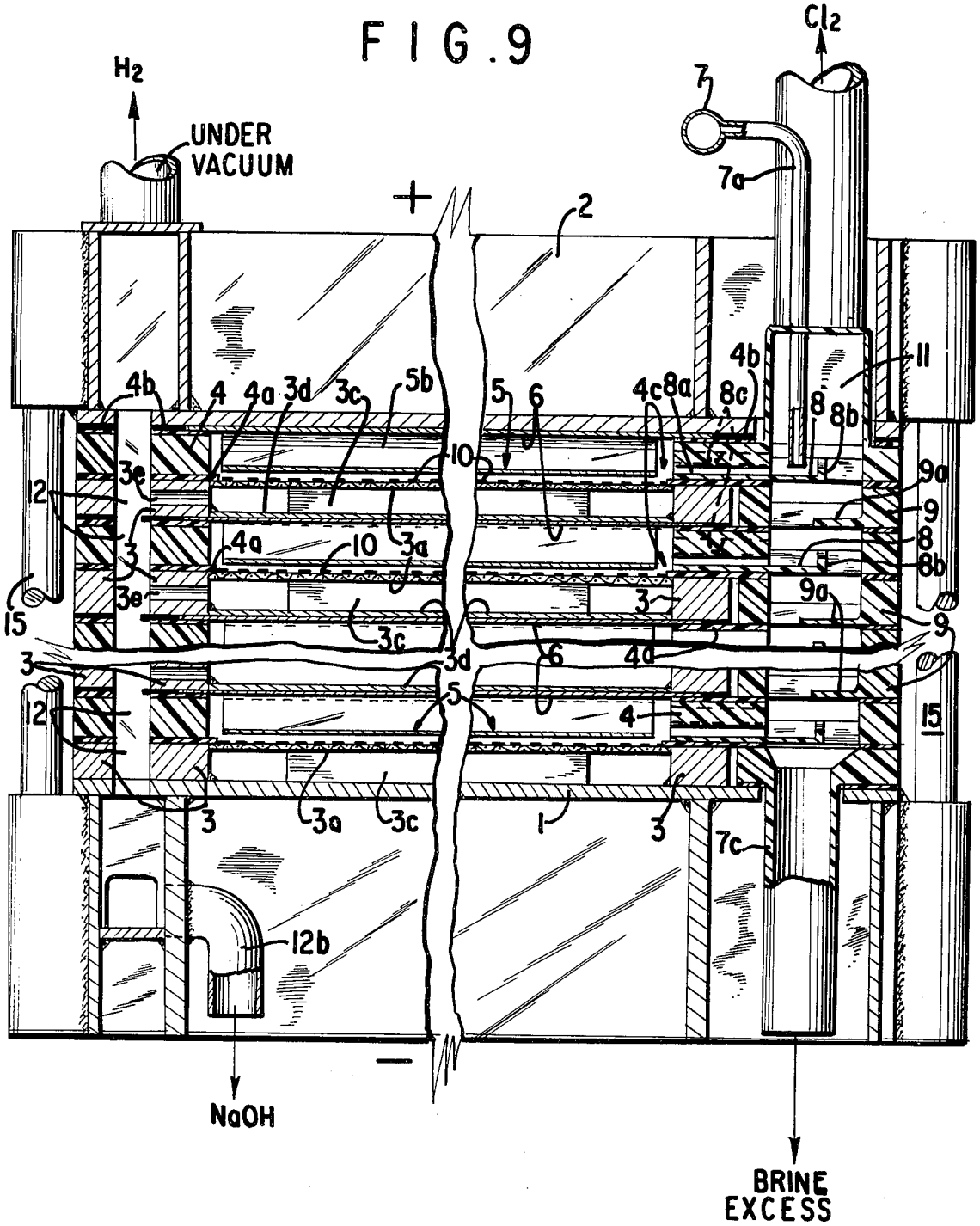
FIG. 9 is an enlarged detail of the right and left side of several of the cell sections of the embodiment of FIG. 5.
Figure 9A:
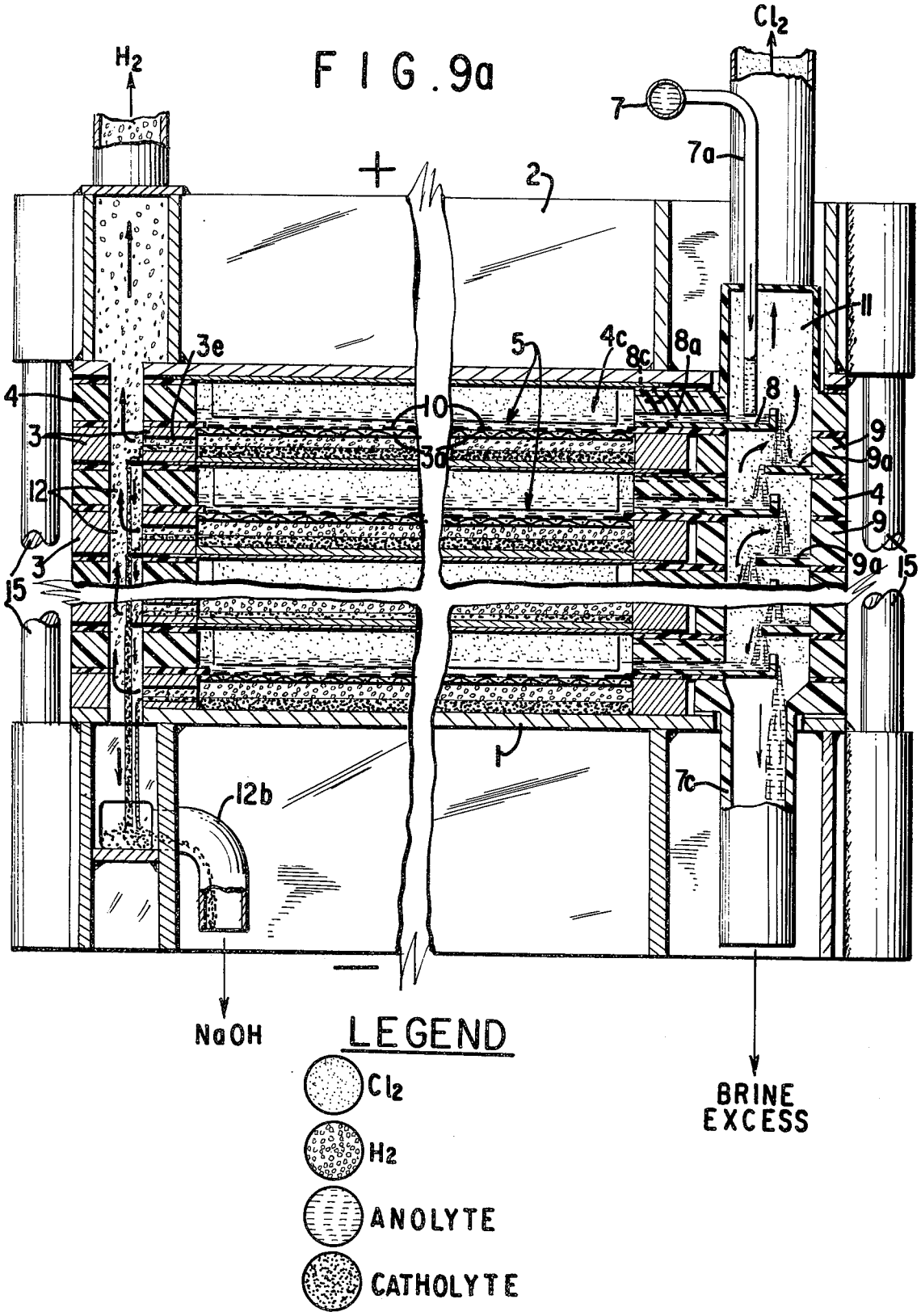
Figure 10:
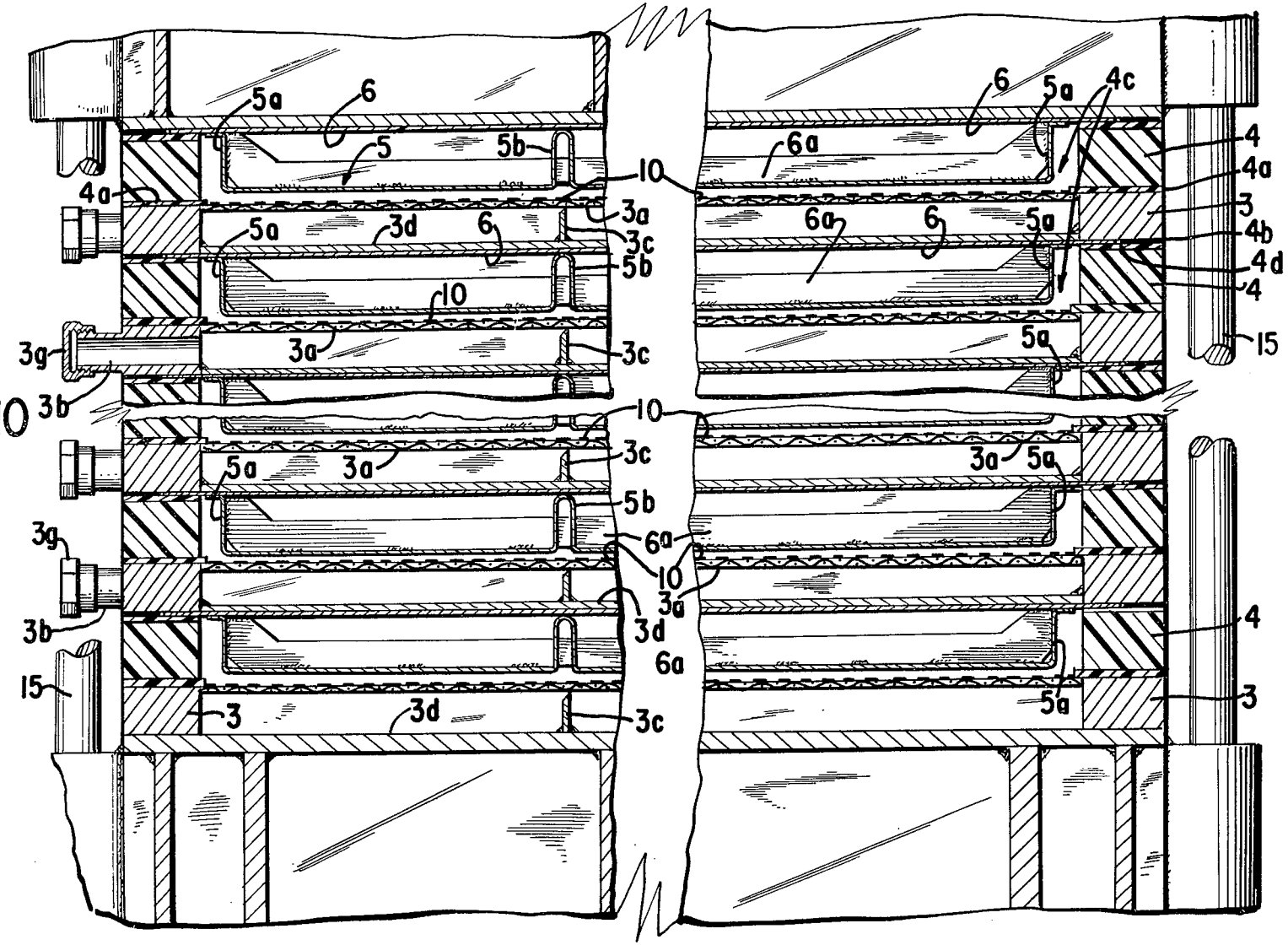
Figures 11, 12, 13, 14, 20:
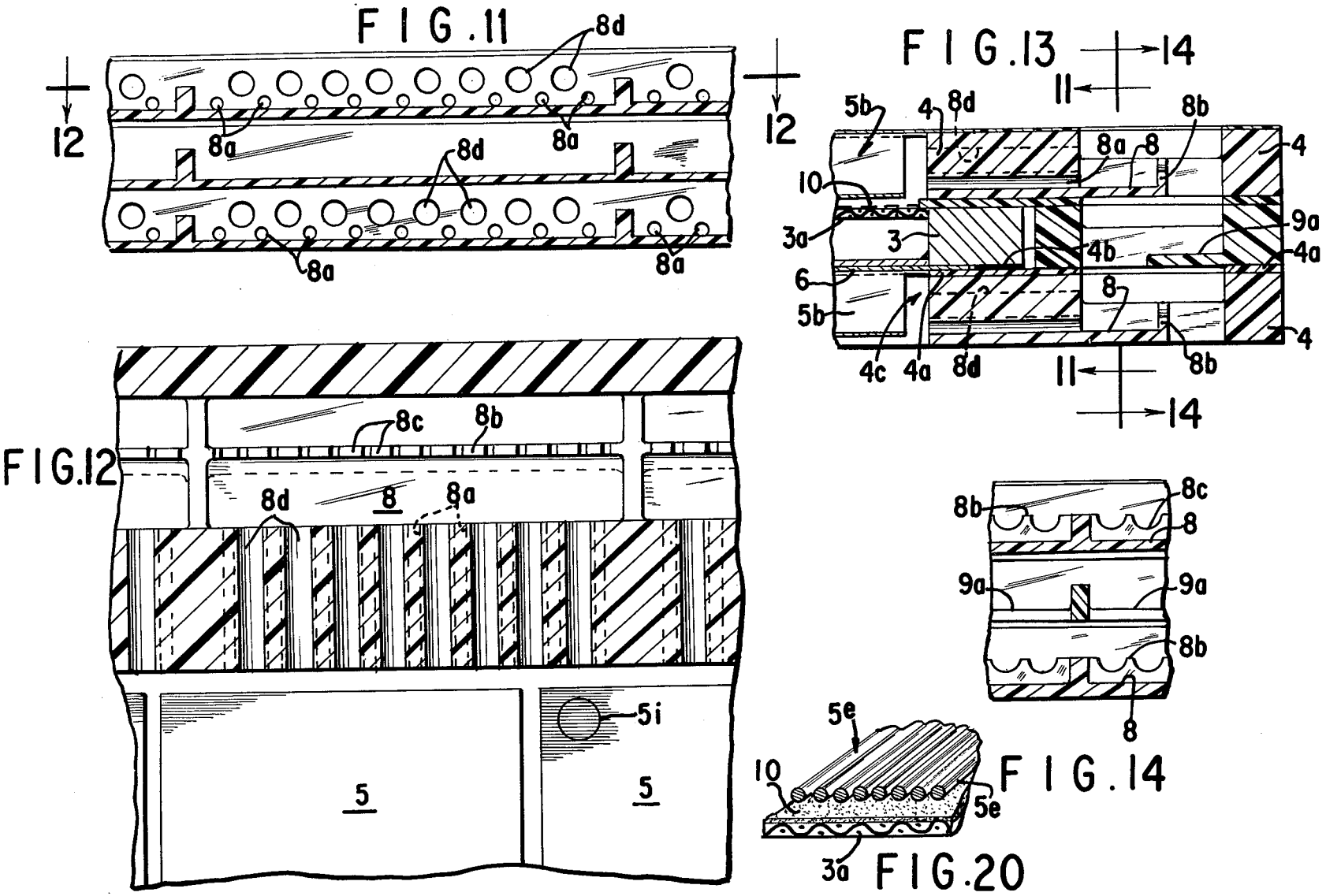
Figure 15:
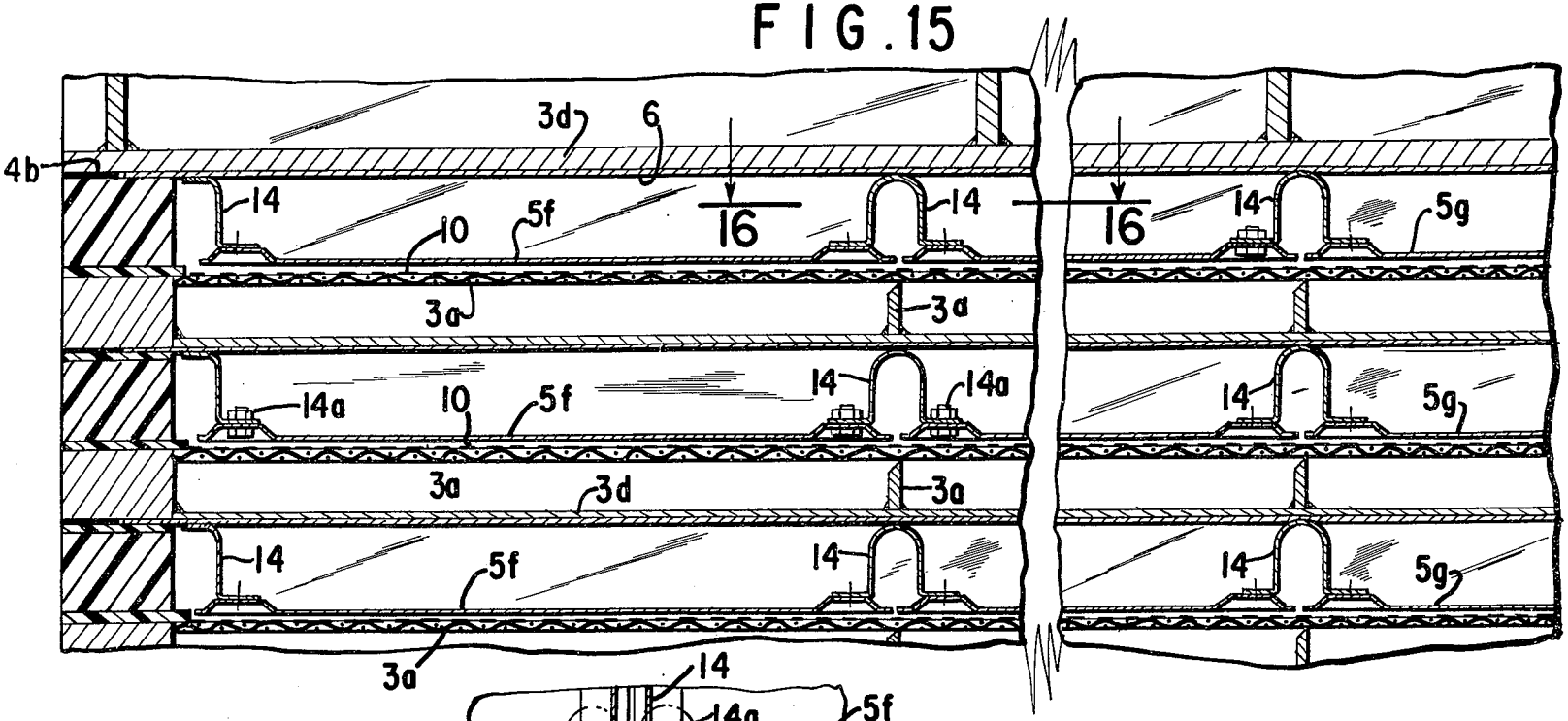
Figure 16:
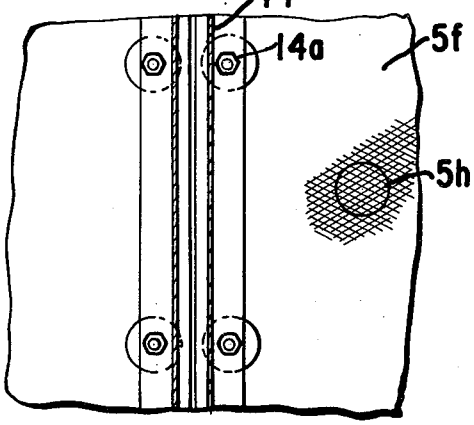
Figure 19:
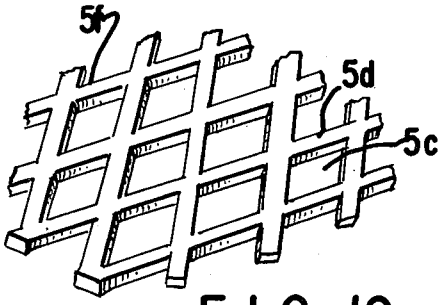
Figure 17:
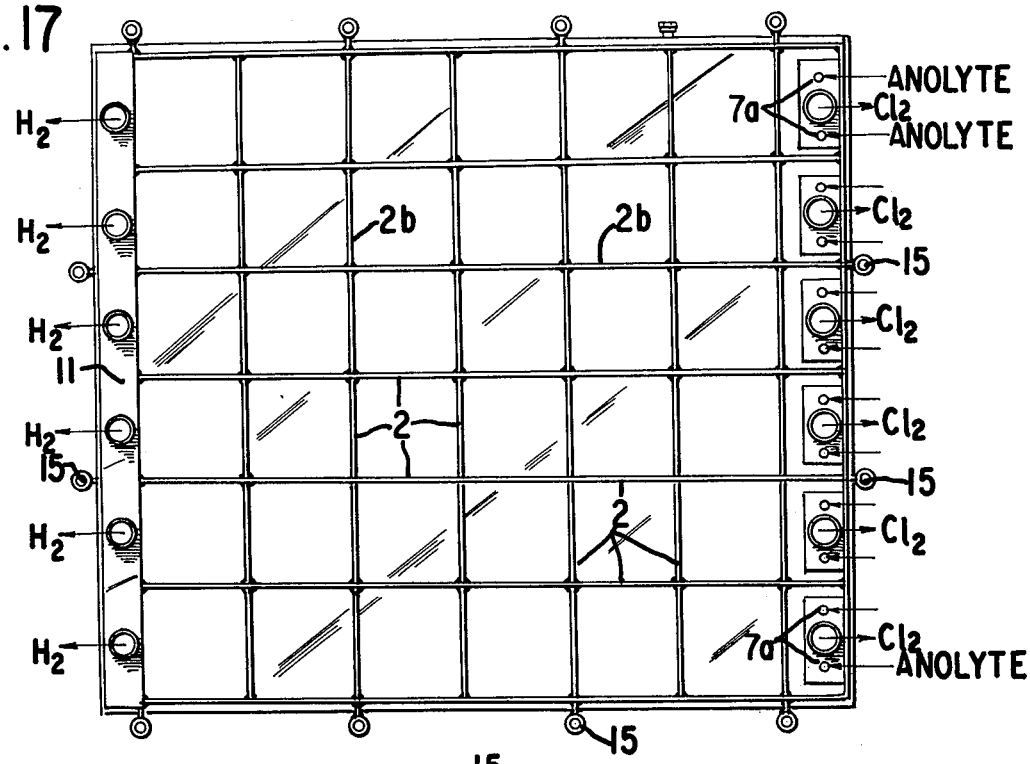
Figure 18:
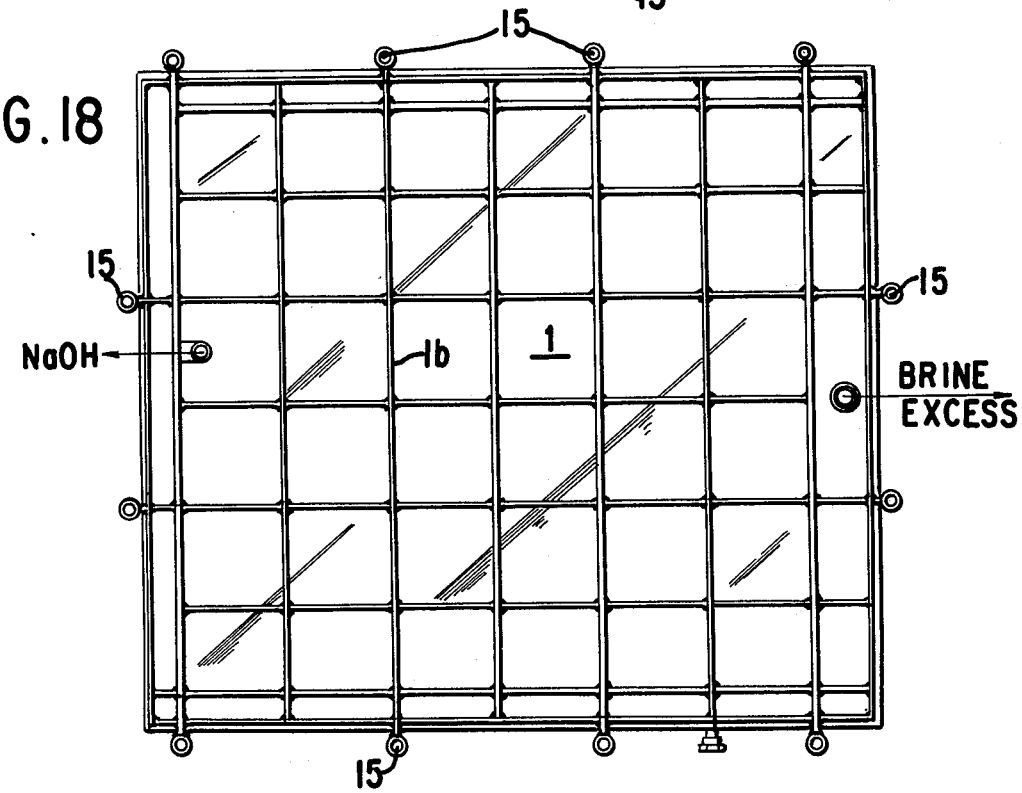

FIG. 9*a* is a detail similar to FIG. 9, showing graphically the flow of gases and liquids within the cell of FIG. 5;

FIG. 10 is a partial transverse section through the electrolyzer of FIG. 5;

FIGS. 11, 12, 13 and 14 are detail views of the brine feed and anodic gas discharge means, in which FIG. 11 is a vertical sectional view along the line 11 — 11 of FIG. 13; FIG. 12 is a horizontal part sectional plan view along the line 12 — 12 of FIG. 11; FIG. 13 is an enlarged detail of the brine feed and anodic gas discharge end of each cell of FIG. 5; and FIG. 14 is a sectional view along the line 14 — 14 of FIG. 13;

FIG. 15 is a sectional view of an alternative form of electrical connection between the anodes and the titanium back plate;

FIG. 16 is a sectional view along the line 16 — 16 of FIG. 15;

FIG. 17 is a top plan view of the top plate of the electrolyzer stack of FIG. 5;

FIG. 18 is a bottom plan view (looking upward) of the bottom plate of an electrolyzer stack of FIG. 5; and FIGS. 19 and 20 are enlarged plan views of two forms of open mesh anode construction showing the voids through which the anodic gases escape upwardly into the anodic gas space.

While the cell is illustrated and described as a series of stacked bipolar cell units, it will be understood that individual cell units of the type illustrated having only one anode and one cathode may be built and operated as individual unipolar cells.

In the embodiment of the horizontal, planar bi-polar cell illustrated in FIGS. 1 to 4, to cell comprises a plurality of stacked bipolar elements in a cell stack A which may consist of fifty or more individual cell units of similar construction, of which only four complete units are shown. Each unit is formed by a rectangular steel frame A1, A2, A3, A4, A5, etc., having top and bottom flanges F1 and F2 in which each lower flange F2 rests upon the upper flange F1 of the next lower unit, insulating gaskets F3 being provided between the units to form a liquid tight seal.

Figures 1, 1A, 1B:
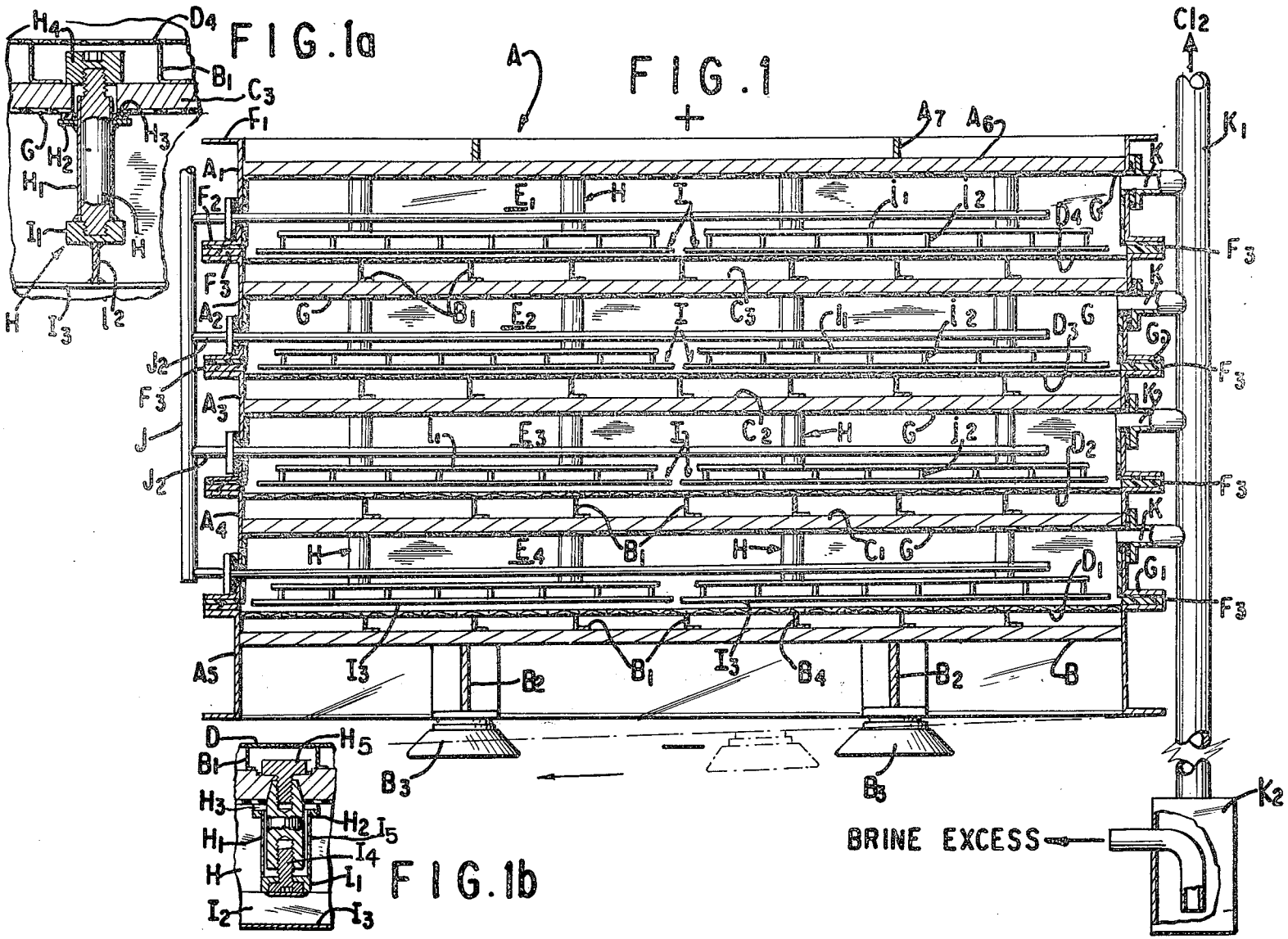

Each frame A1, A2, A3, etc. houses a cathode section in one portion of the frame and an anode section in the other portion, so that when the frames are assembled as shown in FIG. 1 the anode section of one frame is above the cathode section of the next lower frame. The construction of the top frame A1 and bottom frame A5 differ slightly from the intermediate frames as shown in FIG. 1. The bottom frame A5 has a rectangular flat steel sheet B welded or otherwise secured in good electrical connection in the frame approximately one-third the distance from the top of the frame, forming the bottom plate of the cell stack. The bottom plate B has reinforcing ribs B2 extending from side to side of the plate B and rests on insulating supports B3. The frame A5, the bottom plate B and the reinforcing ribs B2 are welded together into an integral structure and the negative bus bars (not shown) are connected to the bottom plate B. Similar plates C1, C2 and C3 are shown for the upper cell units of the cell stack A. While the cell stack A will be described as substantially horizontal, it will be understood that the cells are sloped 1° or 2° from the horizontal, to provide better drainage of catholyte or other liquid from the cell units.

A plurality of angle iron cathode screen support bars B1 are welded or otherwise secured to the top of plate B and to similar bottom plates C1, C2 and C3, and the cathode screens D1, D2, D3 and D4 are welded to the top edges of the frames A2, A3, A4 and A5 and tack welded to the tops of the angle iron supports B1. The cathode screens D1, D2, D3 and D4 are covered with diaphragms of asbestos fiber, paper or cloth (not shown). The space between the cathode screens D1, D2, etc. and the bottom plates B, C1, C2 and C3 and the surrounding walls of the rectangular frames A2, A3, A4 and A5 constitute the cathode compartments of the cell stack A.

The anode compartments are in the lower (approximately) two-thirds of the next upper frames A4, A3, A2 and A1 and are shaped like inverted boxes, E1, E2, E3, E4. The anode boxes E1, E2, E3, E4 are lined with a material which is resistant to the cell conditions. The linings G may be titanium, tantalum, hard rubber or plastic which will protect the sides and tops of the inverted anode boxes from the corrosive effect of brine and anodic gases. The linings G are extended under the bottom flanges F2 of the frames A1, A2, A3 and A4 as indicated at G1, and rest upon insulating gaskets F3 so that the anode compartments are fully insulated from the cathode compartments.

Anode supports or lead-ins H are connected to the bottom plates C1, C2, C3 and top plate A6 of the top frame member A1 to support anodes I within the anode boxes or compartments E1, E2, E3 and E4 through primary conductor bars I1 (FIG. 2), connected to secondary conductor bars I2, running at right angles to primary conductor bars I1. The secondary conductor bars I2 are connected to the anode working faces I3 of the anodes which may be in screen, mesh, rod or other open forms having from approximately 30 to 60% voids, so that gas released at the anodes may readily pass upward therethrough. The anode structure I, I1, I2, I3 is made of a valve metal such as titanium or tantalum or alloys thereof and the primary and secondary conductor bars and working faces are preferably welded together. The anode supports H may be titanium clad copper or any other electrically conductive material, suitably insulated or protected from the corrosive conditions of the anodic compartments. The anode working faces I3 are formed of thin sheets (approximately 0.5 to 1.5 mm) of a valve metal, spaced about 4 to 10 mm above the cathode screens. Typical open anode faces having approximately 50% voids, are illustrated in FIGS. 19 and 20, hereinafter described, and are coated with an electrically conducting electrocatalytic coating of one or more oxides of platinum group metals together with other protective oxides such as oxides of titanium or with a coating of platinum group metals in metallic form.

When titanium or tantalum is used to form the linings G of the anode boxes E1, E2, E3 and E4, these linings may be welded or otherwise electrically connected to the preceding cathode bottom plates C1, C2, C3 and A6, the linings G may then act as back plates for the anode structures I to I3 and the anode structures may be electrically connected to the back plates as illustrated in FIG. 10 and 15, as more fully described hereinafter in connection with these figures.

The top plate A6 is welded into the top frame A1 and is provided with reinforcing ribs A7 and the positive bus bars (not shown) are connected to the top plate A6. The cells operate as bipolar cells with current flowing through the top plate A6 and through all the cells in the stack to the bottom plate B.

Brine is introduced into each anode compartment E1, E2, E3 and E4 from bine feed lines J through branch lines J2 all of which are closed to the atmosphere. In the amount necessary to maintain the desired brine level and maintain flow through the diaphragms, the brine level being increased as the porosity of the diaphragms decreases, as hereinafter described. In the electrolysis of sodium chloride brine, chlorine gas flows out from each anode compartment through chlorine outlets K into chlorine headers K1 and to the chlorine recovery system. As illustrated in FIG. 9a, a gas release space is provided above the anolyte liquor level in each anode compartment. Any excess brine flowing through the outlets K is recovered in trap K2 and returned for resaturation. Hydrogen escapes from the top of the cathode compartments through outlets L to the hydrogen recovery line L1 and sodium hydroxide flows from the bottom of the cathode compartment through outlets M1 preferably located on the side of the cell opposite the $Cl_2$ and $H_2$ outlets. The cell is sloped about 1° to 2° toward the sodium hydroxide outlets M1.

The cell stack of FIGS. 1 to 4 is kept in fluid tight relation by the gaskets F3 between each of the frames A1 to A5 and by the weight of the frames and of the electrolyte therein. However, clamps between each frame member or tie rods similar to tie rods 15 shown in FIG. 5, may be used to hold the cell stack together.

In the specific form of bipolar connection between the cathodes and anodes illustrated in FIG. 1*a*, the anode working faces I3 are connected to secondary conducting bars I2 which are connected to primary conducting bars I1. The primary titanium conducting bars I1 are connected to copper stems H covered with an insulating coating H1 of titanium, rubber or the like and collars H2 (FIG. 1A) at the top of the stems H press against gaskets H3 to form a fluid tight seal with the underneath portion of the cathode bottom plates C1, C2, C3, etc. Nuts H4 are screw threaded on to the top of anode supports H and bear against the cathode bottom plates C1, C2, C3 and A6 to provide electrical connection between the cathode bottom plates and the anodes I.

FIG. 1*b* illustrates a modified form of bipolar connection between the cathode bottom plates C1, C2, c3, etc. and anodes I, in which the primary titanium conducting bars I1 are connected to copper stems H by bolts I4 covered by titanium protectors I5 and the top portion of stems H are beveled and fit into correspondingly beveled openings in the cathode bottom plates C1, C2, C3, etc. A threaded bolt H5 is used to draw the beveled portions of the stems H into the bevels in the cathode bottom plates C1, C2, etc.

The embodiment of the horizontal, planar, bipolar cell A illustrated in FIGS. 5 to 18, is intended to show a stack of fifty or more individual cell units mounted on a steel bottom plate 1 to which the negative connection to the electrical circuit is made and covered by a steel top plate 2 to which the positive bus bar is connected, with the bipolar cell units mounted between the bottom plate 1 and top plate 2.

Each cell unit is composed of a rectangular steel frame 3 constituting the enclosure for the cathode compartment and an insulating rectangular anode frame member 4 of glass fiber reinforced polyester or other suitable insulating material constituting the anode compartment. A steel cathode screen 3*a* is spot welded at several places to the upper inner corner of each cathode frame 3, and each cathode screen is adapted to support a diaphragm 10 (shown in dash lines in FIGS. 10 and 15), which may be a woven sheet of asbestos cloth or other suitable diaphragm material or an asbestos fiber diaphragm applied by suction to the cathode screens 3*a*. Suction nozzles 3*b* (FIG. 10) are provided in frames 3 for the initial deposit of diaphragm material on the cathode screens 3*a*. The lower face of each of the cathode screens is supported on steel ribs 3*c* which are welded to the steel bottom plate 3*d* of each cathode frame and tack welded to the cathode screens 3*a* to support the screens and provide good electrical connection between the cathode screens and the cathode frame bottom plates.

A rubber gasket 4*a* (FIGS. 10 and 13) rests upon the top of each cathode frame 3 and provides spacing and a fluid tight seal between the steel cathode frames 3 and the insulating polyester anode frames 4.

The anodes 5 are formed of thin sheets (approximately 0.5 to 1.5 mm) of a valve metal, resistant to the cell conditions, such as titanium or tantalum or alloys of titanium or tantalum having a conductive electrocatalytic coating containing a mixture of oxides of titanium or tantalum, oxides of a platinum group metal or oxides of other metals, or the anode faces may be covered with a platinum group metal in metallic form. The anodes 5 may be in the form of mesh, screen, rods or the like and may be coated on either or both the front and back face of the anode with said electrically conducting electrocatalytic coating. The active faces of anodes 5 are spaced about 4 to 10 mm above the cathode screens 3*a* and diaphragms and extend into the anolyte liquor for a suitable distance to provide efficient electrolysis of the anolyte liquor in the electrode gap between the anode faces and the cathode screens 3*a*.

The anodes 5 are suspended in the anode frames 4 from a titanium (or tantalum) back plate 6 which rests against the cathode bottom plates 3*d* of the next higher cathode element and makes electrical contact with the back plates 3*d* by bolting, welding, or the like. The titanium back plates 6 rest against thinner gaskets 4*b* on the top of gaskets 4*d* on the polyester frames 4 (FIG. 10, right side). Gaskets 4*b* provide spacing for the back plates 6. The anodes 5 are secured to the back plates 6 by legs 5*a* tack welded to the back plates 6 and by integral (or separate) inverted U-shaped legs 5*b* (FIG. 10), also welded to the back plates 6 to make an electrical contact with the back plates, so that the electric current flows into the cell stack from the positive terminals 2*a* (FIG. 5) through each cell unit in the stack and to the negative terminals 1a connected to the bottom plate 1.

Figure 8:
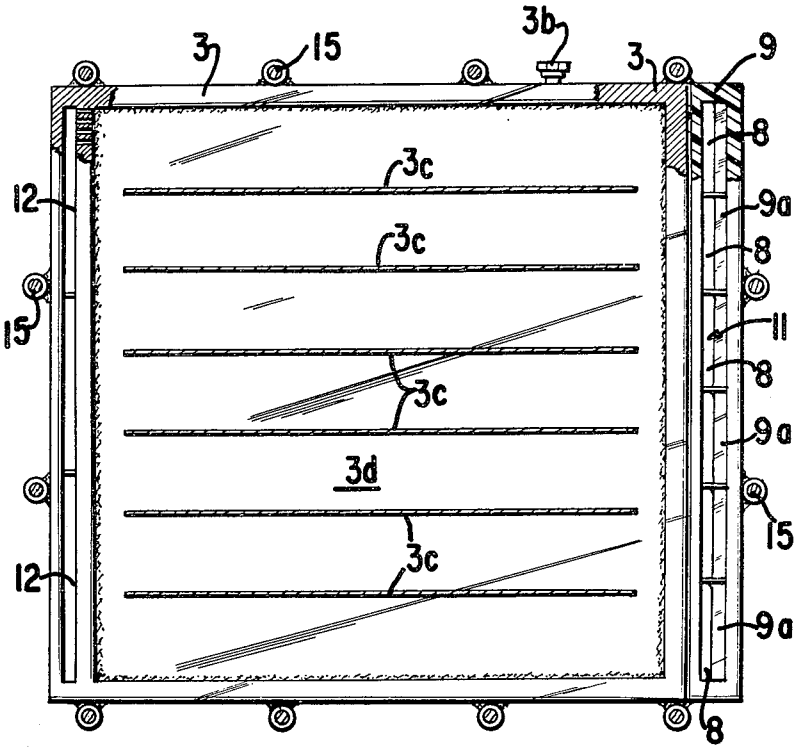
FIG. 8 is a plan view through one of the steel frames of one of the cathode sections, substantially along the line 8 — 8 of FIG. 5.
Figure 7:
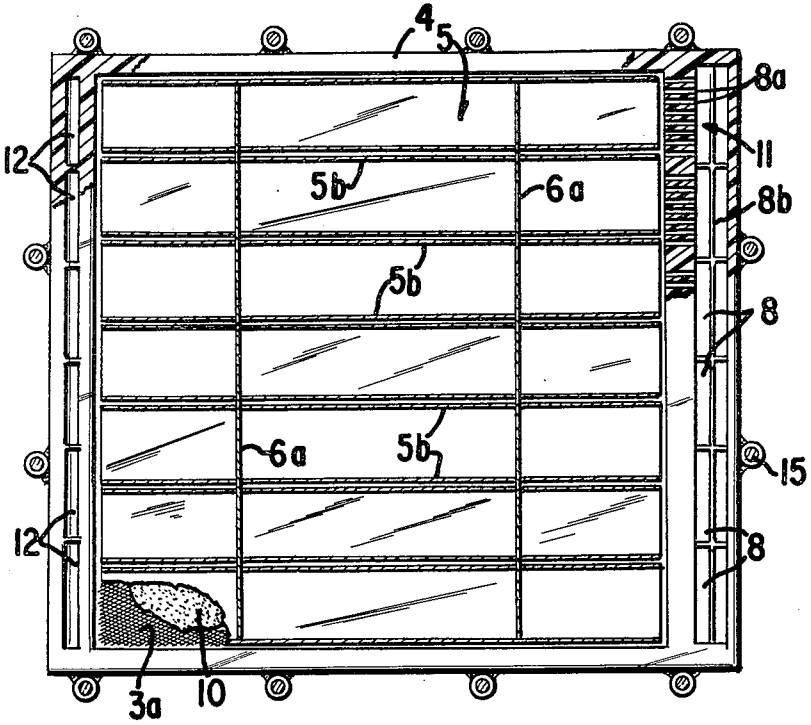
FIG. 7 is a plan view through one of the insulating polyester frames of one of the anode sections of the embodiment of FIG. 5, substantially along the line 7 — 7 of FIG. 5.

Brine flows into the top anode chamber in the anode frames 4 from a brine feed line 7 and a series of branches 7*a* and discharges in a plurality of streams onto a balcony 8 located toward the bottom of each anode frame 4 and extending along one side of each anode frame 4 (see, FIGS. 9, 9*a* and 12). Each balcony 8 is terminated with a weir (lip) 8*b* provided with semicircular notches 8*c*. From the balcony 8, the brine flows into the anode chamber 4c through a series of feed holes 8a. Sufficient brine is fed into the cell stack to allow the liquor to percolate at the required flow rate through the diaphragms 10 while a constant static head is kept above the anolyte level in the anode chambers 4c over the active faces of the anodes 5. This is obtained by feeding the brine with some excess over the percolating flow rate, so that the excess stream will overflow from the notches 8c at the top of the weir (lip) 8b and pass downward onto the next lower deflector ledge 9a which occupies a space in the cell stack adjacent to the end of each cathode frame on the brine feed inlet side. The discharged end of the branches 7a are below the level of the anolyte on balcony 8 so that the feed inlet is closed to the atmosphere. Brine may alternatively be introduced onto each balcony 8 by separate branches 7a leading from the brine feed line 7 to each of the balconies 8. As shown in FIGS. 8, 9 and 13, the steel cathode frames 3 are shorter than the anode frames 4 and the polyester inserts 9 occupy the gap between those parts of the anode frames that project outwardly of the cathode frames. Each insert 9 has a deflector ledge 9a which deflects the downwardly flowing brine stream onto the next lower balcony 8 in the cell stack. Each balcony will thus be fed with brine at a flow rate sufficient to keep a static head over the anodes in the corresponding anode chamber and provide an overflow stream feeding the lower anode chambers. As shown in FIGS. 5 and 9a,the excess stream overflowing from the lowest balcony leaves the stack from the brine exit line 7c and passes through a trap 7d into a recycling line 7b. A sight glass 7e in the exit line 7c enables the operator to observe the brine flow from the cell stack and to regulate the rate of brine feed to provide the desired excess flow.

During operation of the cell, the brine in each anolyte compartment, formed by the anode frames 4, stands at the upper level of the notched weirs (or lips) 8b and flows through the diaphragms 10 and the cathode screens 3a, into the catholyte compartment in the bottom of each cathode frame 3. In the electrolysis of sodium chloride brine, to produce chlorine, sodium hydroxide and hydrogen, chlorine is released at the anodes 5 and passes upwardly through the void areas of the anode mesh and into the chlorine space at the top of the anodic chambers 4c and flows out of the polyester anode frames 4 through chlorine outlets 8d (shown in full lines in FIG. 11 and in dash lines in FIG. 13) and into the chlorine discharge chamber 11 which extends from the top to the bottom of the cell stack A and into the chlorine header 11a from which it flows to the chlorine recovery system.

Sodium hydroxide and hydrogen are produced at the cathode screens 3a and flow through the holes 3e in the cathode frames 3 into the hydrogen and sodium hydroxide discharge slots 12, which extend from top to bottom of the cell stack A, on the side opposite the brine feed inlet. In the interconnected slots 12, the hydrogen separates from the sodium hydroxide and flows upwardly to the $H_2$ outlet 12a and to the hydrogen recovery system while the catholyte consisting of sodium hydroxide (about 11 to 12% strength) and depleted brine flow through the NaOH outlet 12b to the NaOH recovery system.

For the proper operation of a diaphragm electrolyzer, a certain pressure is needed in each anodic compartment, to drive the anolyte through the diaphragms into the cathodic compartments.

It is not convenient in a stacked horizontal, planar bipolar diaphragm cell such as described above, to apply this pressure by the normally used single static liquid head on each anolyte chamber as used in normal diaphragm cells, because in the cell stack A of FIGS. 1 to 4 or FIGS. 5 to 18, the elements are on different levels and the number of elements is large. However, the desired pressure on the anodic side of each element in cell stack A may be maintained in either of two ways:

a. by throttling the discharge of the produced chlorine gas by means of a throttling valve (not shown) in the chlorine header K1 or 11a, while the produced hydrogen leaves the cathodic compartments without being throttled, so as to create chlorine gas pressure which acts equally on the anolytes of all elements; or
b. to suck the produced hydrogen gas into header L1 or 12a under a certain vacuum relative to the chlorine gas, while the chlorine leaves the electrolyzer at about atmospheric pressure so that the pressure difference created acts through the chlorine outlet holes K or 8d equally on the anolytes of all elements to maintain the desired pressure differential. By either of these methods, a positive pressure differential between each anolyte compartment and its corresponding catholyte compartment may be maintained.

Method (b) is preferred, because a chlorine pressure in the anodic compartments as described under (a) would cause a slight increase of the chlorine solubility in the anolyte, followed by a corresponding increase of chlorate in the produced caustic liquor. The numeric value of the pressure difference according to methods (a) or (b) is dictated by the operation parameters, i.e., the obtainable NaOH percentage and the coordinated chlorate content of the produced caustic liquor. This pressure difference depends upon the current density, the type of diaphragm and the age of the diaphragm, in other words, during one life period of the diaphragms the pressure difference according to the above explained methods (a) or (b) has to be adjusted from time to time, as in any other type of diaphragm chlorine cell, because the diaphragms become less permeable the longer they are used.

The caustic liquor leaves the cathodic compartments through bore holes 3e of the rectangular steel frames 3 and leaves the electrolyzer through the bottom, the produced hydrogen flows through the same bore holes, connecting each cathodic compartment with the chamber 12 of the corresponding rectangular steel frame and flows upwards through the common room formed by the chamber 12 of all steel and polyester frames and leaves the electrolyzer through the outlet 12a on the top of the cell A. All the slots of the steel frames, together with the alternating polyester frame slots of the whole bipolar electrolyzer forming the chamber 12, are connected vertically and form a common channel which guides the hydrogen upwards and the caustic liquor downwards to the common catholyte outlet on the bottom of the electrolyzers, which is equipped with a gas guard 12c maintained full of catholyte liquor to prevent escape of hydrogen from the bottom of cell stack A and assure separation of the hydrogen from the catholyte liquor.

The titanium back plates 6 are connected to the dimensionally stable metal anodes 5 by vertical ribs 6a (FIG. 10) which run at right angles to and intersect the inverted-U ribs 5b of the anodes 5 and are welded to the titanium back plates 6 and to the inverted-U sections 5 of the anodes. The titanium ribs 6*a* and the inverted-U ribs are distributed so as to provide a minumum voltage drop between the back plates 6 and the anodes 5.

The titanium back plates 6 may be mechanically connected to the bottom plates 3*d* of the cathode frames 3 by bolting, welding or the like. To improve the electric contact, the contact face of the bottom plates 3*d* and the titanium back plates 6 are partially sandblasted and covered with a sprayed thin layer of a soft metal such as copper, lead and the like.

Suction nozzles 3*b* (FIG. 10) are provided in each cathode frame 3 to facilitate the deposition of diaphragm material indicated by dash lines 10 in FIGS. 9 and 10 on the cathode screens 3*a*. When not in use for diaphragm deposition, the suction nozzles 3*b* are closed by caps 3*g*. With the horizontal, planar cathode screens 3*a*, however, woven asbestos diaphragm cloth or any other suitable type of prefabricated diaphragm material may be used in place of suction deposited diaphragms.

As illustrated in FIGS. 19 and 20, the active faces of the dimensionally stable valve metal anodes I3 and 5 may be in various forms of titanium or tantalum bases provided with electrically conducting electrocatalytic coatings of mixed oxides of titanium or tantalum, and a platinum group metal oxide, or other metal oxides or platinum group metals. The titanium or tantalum bases to which these coatings are applied may have various forms such as solid rolled massive titanium plates, perforated plates, slitted, reticulated titanium plates, titanium mesh and rolled titanium mesh, woven titanium wire or screen, titanium rods and bars or similar tantalum and other metal plates and shapes, all of which are referred to as having approximately 50% void areas. The preferred method of applying the coatings is by chemi-deposition in the form of solutions painted, dipped or sprayed on or applied as curtain or electrostatic spray coatings, baked on the anode base or by electroplating if platinum group metal coatings are used.

FIG. 19 is an enlarged detail view of a titanium mesh base for the anodes I3 and 5, indicated within the circle 5H on FIG. 16, in which the open or void portions 5*c* of the mesh exceed the solid portions 5*d* of the mesh. The open area of the mesh should be 30 to 60% of the metal area of the anode face, preferably 50 to 53%. FIG. 20 is an enlarged detail view of a titanium anode base, indicated within the circle 5*i* on FIG. 12, in which coated spaced rods 5*e* constitute the active face of the anode and in which the open portions between the rods are greater than the solid area of the rods. A portion of the cathode screen is shown at 3*a* and a portion of the diaphragm at 10. This open or void construction facilitates ready passage of electrolysis gases released at the anodes, up through the anode faces and into the electrolyte and gas space above the anodes and eliminates gas blanketing encountered when graphite anodes are used.

Figures 2, 3, 4:
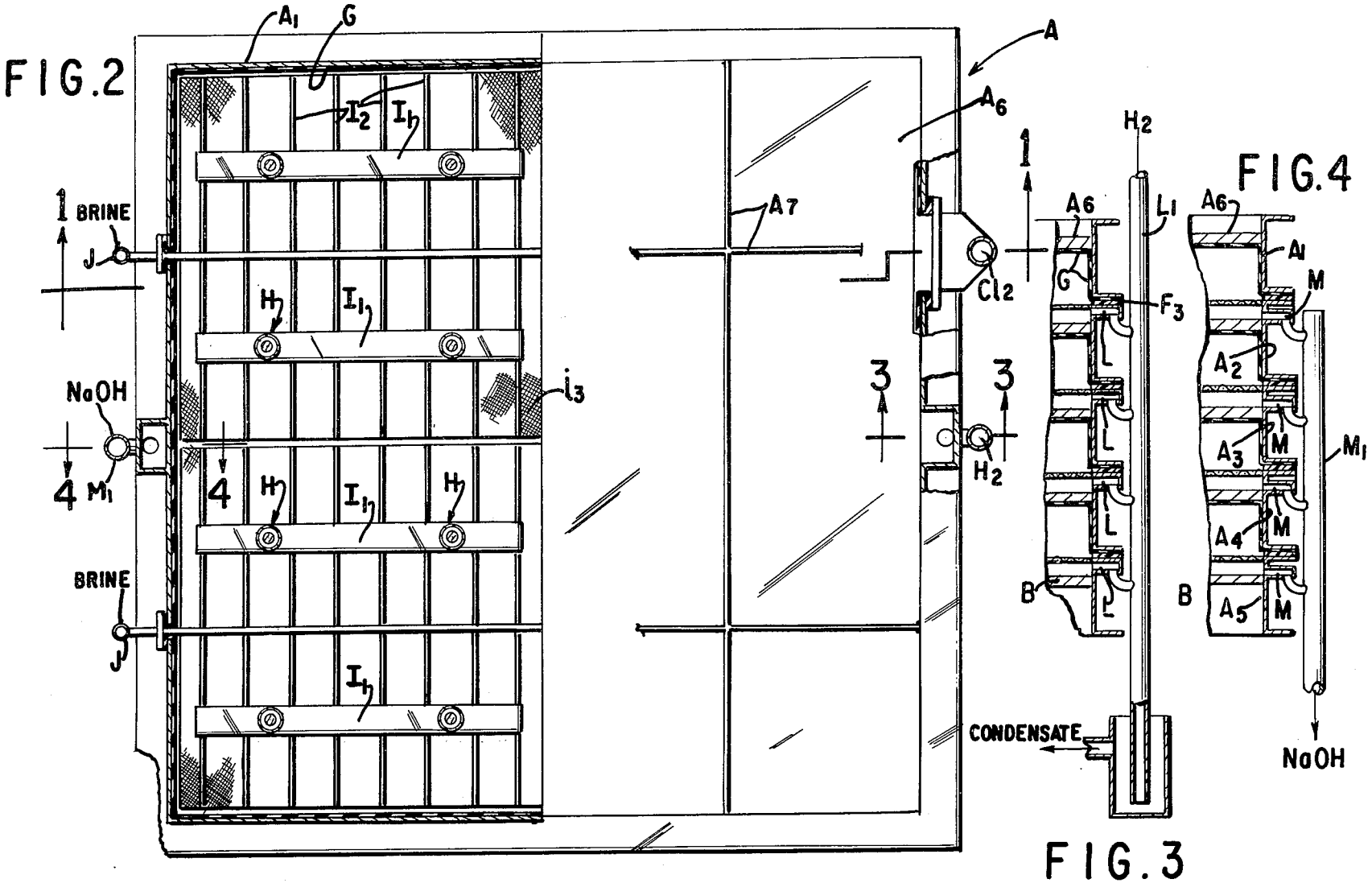
FIG. 2 is a plan view, partially in section, of the cell illustrated in FIG. 1.
FIG. 3 is a cross sectional illustration of the cathodic gas discharge system, substantially along the line 3 — 3 of FIG. 2.
FIG. 4 is a cross sectional illustration of the catholyte liquor discharge system, substantially along the line 4 — 4 of FIG. 2.
Figure 6:
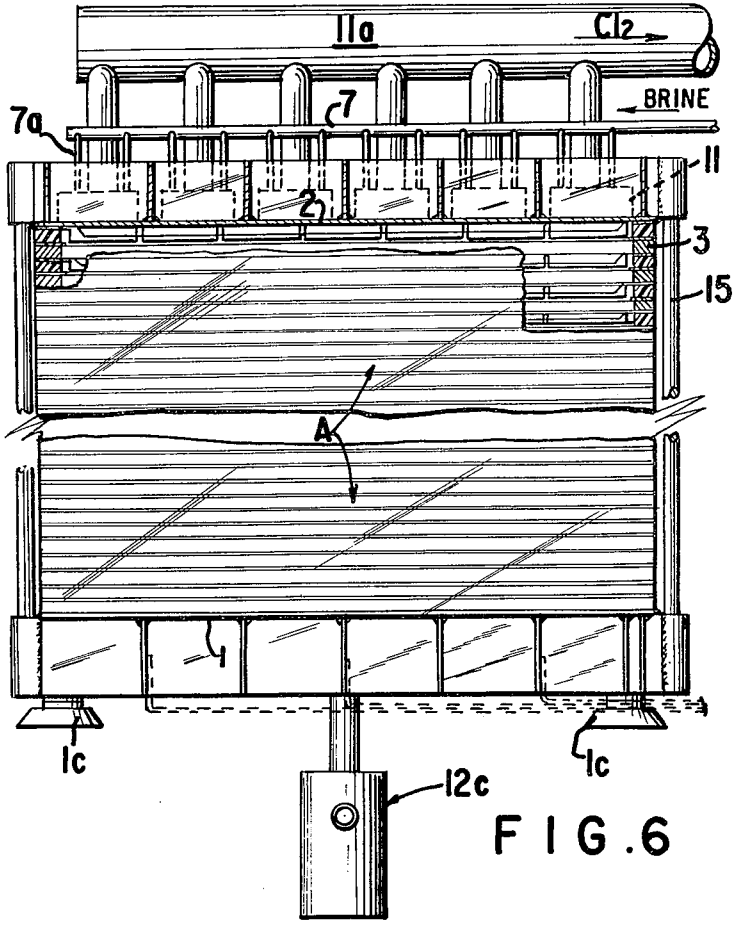
FIG. 6 is a part sectional view, substantially along the line 6 — 6 of FIG. 5.

The anode bases illustrated in FIGS. 19 and 20 and at I3 in FIG. 2, provided with electrically conductive electrocatalytic coatings thereon, are almost as flexible as a sheet of cardboard and can be bent into any shape desired such as bent legs 5*a* or inverted-U ribs 5*b* and welded or otherwise secured to, for example, the titanium back plates 6 and ribs 6*a*, or the bottom plates C1, C2, C3, etc., without losing any of the coating from the base.

FIGS. 15 and 16 illustrate an alternative construction in which separate anode faces 5*f* and 5*g* are secured by means of bolts and nuts 14*a* to the back plates 6 by bolting to titanium brackets 14, welded to the back plates 6. In order to disconnect the anode faces 5*f* and 5*g* from the back plate 6, it is only necessary to remove the bolts 14*a*, after which the anode face 5*f* or 5*g* may be separated from the bracket 14 and new anode faces installed or the old ones recoated and reinstalled. This construction permits the use of smaller equipment for anode activation (coating) and reactivation (recoating). However, more labor is necessary for assembling and disassembling and there is a voltage drop at the bolted connections.

The bottom plate 1 (FIG. 18) and the top plate 2 (FIG. 17) are provided with reinforcing ribs 1*b* and 2*b* and the cell stack A is held together by a plurality of threaded long bolts 15 extending between the bottom and top plates. Insulating supports 1c are provided for bottom plate 1.

The cathode screens of these cells are especially designed to be loaded at a current density of 3000 $A/m^2$, or higher, so that cells of this invention can be operated at higher current densities and are therefore more efficient than cells of the prior art.

While two embodiments of the invention have been described, it will be understood that various other embodiments of the principles of the invention may be made within the scope of the following claims, and that the cell may be used for other purposes than specifically described and may be used as a single unit monopolar cell or as a multiple unit bipolar cell as illustrated.

What is claimed is:

1. In the electrolysis of aqueous alkali metal halide solution, the method which comprises conducting the electrolysis between an anode and a horizontally oriented electrolyte permeable cathode disposed below the anode with a diaphragm between anode and cathode, collecting evolved gaseous halogen in a gas space above the level of the aqueous alkali metal halide solution and removing the gaseous halogen separate from the halide solution and maintaining a differential pressure between said collected halogen and the area under the cathode to enhance downward flow of electrolyte through the cathode.

2. The method of electrolysis of a salt solution in a bipolar diaphragm electrolysis cell provided with an anode compartment having an anolyte liquor chamber and a gas chamber therein, horizontal substantially planar valve metal anodes in said anode compartments having openings therethrough in which the openings substantially equal the solid metal areas of said anodes and having an electrically conducting electrocatalytic coating on said anodes and provided with cathode compartments with diaphragms and cathode screens below said anodes, which comprises passing the gases released at the anodes upwardly through the openings in said anodes into the anodic gas chamber above said anodes, and discharging said gases from said cell above the anolyte liquor compartment, passing the salt solution downwardly through said diaphragms and cathode screens into a cathode compartment and separating the gases and liquids formed in said cathode compartment and separately discharging the gases and liquids formed in said cathode compartment from said cell.

3. The method of claim 2, in which a hydrostatic pressure differential in excess of the normal anolyte liquor pressure is maintained in said cell to control the flow of salt solution through said diaphragms.

4. The method of claim 3, in which the said hydrostatic pressure differential is increased as the porosity of the diaphragms decreases.

5. The method of claim 3, in which said hydrostatic pressure differential is varied by varying the pressure on the gases in said cells.

6. A horizontal bipolar diaphragm electrolysis cell having a plurality of horizontal cell units in bipolar connection with each other, each cell unit consisting of an anode compartment having an anolyte liquor chamber and a gas chamber therein and a cathode compartment having a catholyte liquor chamber and a gas chamber therein, a frame surrounding each anode compartment and each cathode compartment, means to insulate the frames surrounding said compartments from flow of electricity from the walls of the anode compartments and the walls of the cathode compartments, horizontal substantially planar open mesh valve metal anodes having an electrically conductive electrocatalytic coating thereon, in each anode compartment, a corrosion resistant lining in each anode compartment, a diaphragm, a metal cathode screen and a solid horizontal ferrous metal bottom plate in each cathode compartment, metal electrical connections between each anode and the ferrous metal bottom plate of the cathode compartment above, means to feed anolyte liquor into each of said anode compartments, means above the anolyte liquor feed means to remove anodic gas separate from the anolyte liquor from each anode compartment, means to remove catholyte liquor and cathodic gas separated from the catholyte liquor and metal conductor means to convey electric current to and from each of said cell units to electrolyze the anolyte liquor fed to said anode compartments.

7. the cell of claim 6, in which the anode compartments are surrounding by frames of insulating material and the cathode compartments are surrounded by frames of metal and the said frames are stacked one on top of the other with a cathode screen and diaphragm between each cathode frame and the anode frame above it.

8. The cell of claim 6, in which the anode compartments are surrounded by metal frames having an inert lining, the cathode compartments are surrounded by metal frames, the said anode and cathode frames are insulated from each other and the said frames are stacked one on top of the other with a cathode screen and diaphragm between each cathode frame and the anode frame above it.

9. The cell of claim 8, in which the inert lining in the anode frames is a valve metal.

10. The cell of claim 6, in which each frame surrounding an anode compartment and a cathode compartment is made of metal, the anode compartments and cathode compartments in each frame are separated by a horizontal metal plate which supports a cathode screen and a diaphragm on its upper side and supports the anodes from its lower side, the metal frames are insulated from each other and stacked one on top of the other.

11. The cell of claim 10, in which the anode compartment in each frame is provided with a corrosion resistant lining, resistant to the cell conditions.

12. The cell of claim 7, in which the cathode frames are provided with electrically conductive metal bottom plates and the valve metal anodes have valve metal back plates in electrically conducting contact with the cathode bottom plates.

13. The cell of claim 12, in which the valve metal anode plates are connected by electric conducting valve metal connections to said valve metal back plates.

14. The cell of claim 6, having a metal path for conducting electric current from the conductive ferrous metal bottom plates to the valve metal anode faces, and a metal path for conducting electric current from the metal cathode screens to the metal bottom plates.

15. The cell of claim 12, in which the electric contact surfaces between said cathode bottom plates and the anode back plates are covered with a layer of soft metal from the group consisting of copper and lead.

16. The cell of claim 8, in which the electrically conductive metal bottom plates are welded to the metal cathode frames.

17. The cell of claim 12, in which the valve metal anodes are detachably connected to the valve metal back plates.

18. The cell of claim 6, in which the frames are provided with anolyte feed lines and anolyte gas outlets in each anode compartment and with catholyte gas and catholyte liquor outlets in each cathode compartment.

19. The cell of claim 7, in which the anode frames are provided with feed balconies for feeding anolyte liquor into the anode compartments and permitting escape of anodic gas from the anode compartments and the cathode frames are provided with insulating spacers along one side thereof with deflectors for deflecting anolyte liquor overflowing an upper balcony onto the balcony of the next lower anode frame.

20. The cell of claim 8, in which the metal cathode frames are provided with electrically conducting metal bottom plates, the cathode screens are welded to the metal cathode frames and the screens are supported on ferrous metal ribs extending upward from said bottom plates and welded to said screens.

21. The cell of claim 19, in which all the anolyte liquor is fed into a single anolyte liquor inlet, said inlet is closed to the atmosphere, and an outlet for excess anolyte liquor is provided at the bottom of said plurality of cell units.

22. The cell of claim 6, in which means are provided to exert a positive pressure differential from each anolyte compartment to each catholyte compartment to force anolyte liquor in the anode compartments through the diaphragms and screens into the cathode compartments.

23. The cell of claim 22, in which the positive pressure differential is equal in each anolyte compartment and can be increased or decreased as the porosity of the diaphragms changes.

24. The cell of claim 23, in which the means to exert positive pressure differential from each anolyte compartment to each catholyte compartment comprises suction means applied to the catholyte gas removal means.

25. The cell of claim 22, in which means are provided to exert a pressure differential from the anode compartment to the cathode compartment.

26. The cell of claim 6, in which the means to removal catholyte liquor and catholyte gas from the cathode compartments communicate with a common header extending from top to bottom of said bipolar cell, the top of said header communicates with a catholyte gas discharge outlet and the bottom of the header communicates with a catholyte liquor discharge conduit.

27. The cell of claim 6, in which the cathode frames are provided with means for applying suction to each frame for the purpose of depositing diaphragm material on the cathode screens.

28. The cell of claim 6, in which the planar valve metal anodes have an open mesh form having approximately 30 to 60% void fractions therein.

29. The cell of claim 6, in which the planar valve metal anodes consist of bars lying in the same horizontal plane.

30. An electrolysis cell consisting of anode compartments adapted to contain an anolyte liquor and anode gas and cathode compartments adapted to contain a catholyte liquor and cathode gas, a frame surrounding said anode compartments and said cathode compartments, horizontal substantially planar open mesh valve metal anodes having an electrically conductive electrocatalytic coating thereon, in said anode compartments, a diaphragm, a metal cathode screen and a solid electrically conductive metal plate between the cathode compartments and the next lower anode compartment, means closed to the atmosphere to feed anolyte liquor into said anode compartments, and means above the anolyte liquor feed means separated from the anolyte liquor to remove anode gas from said anode compartments, means to remove catholyte liquor and cathode gas from said catholyte compartments and metal conductor means to convey electric current from said electrically conductive metal plate to said valve metal anodes and through said cell unit to electrolyze the anolyte liquor fed to said anode compartments.

31. A horizontal bipolar diaphragm electrolysis cell having a plurality of cell units in bipolar connection with each other, each cell unit consisting of an anode compartment adapted to contain an anolyte liquor and an anode gas and a cathode compartment adapted to contain a catholyte liquor and a cathode gas, an anode frame surrounding each anode compartment, a metal cathode frame surrounding each cathode compartment, means to insulate said frame surrounding the anode compartments and the frame surrounding the cathode compartments from flow of electricity through the walls of said compartments, horizontal substantially planar valve metal anodes having voids therethrough and having an electrically conductive electrocatalytic coating thereon, in each anode compartment, a diaphragm, a metal cathode screen and an electrically conductive metal plate between each anode and cathode compartment, means to feed anolyte liquor into each of said anode compartments, and means above the anolyte liquor feed means to remove anode gas from said anode compartments, means to remove catholyte liquor and cathode gas from the cathode compartments and metal conductor means to convey electric current from said electrically conductive metal plate to said valve metal anodes and through each of said cell units to electrolyze the anolyte liquor fed to said anode compartments.

* * * * *